US008770996B2

(12) United States Patent
Hsu

(10) Patent No.: US 8,770,996 B2
(45) Date of Patent: Jul. 8, 2014

(54) CARD CONNECTOR

(71) Applicant: Transcendent Electronics Co., Ltd., New Taipei (TW)

(72) Inventor: Kuei-Sang Hsu, New Taipei (TW)

(73) Assignee: Transcendent Electronics Co., Ltd., New Taipei (TW)

( * ) Notice: Subject to any disclaimer, the term of this patent is extended or adjusted under 35 U.S.C. 154(b) by 14 days.

(21) Appl. No.: 13/730,982

(22) Filed: Dec. 29, 2012

(65) Prior Publication Data

US 2014/0099809 A1 Apr. 10, 2014

(30) Foreign Application Priority Data

Oct. 8, 2012 (TW) ..... 101219444 A

(51) Int. Cl.
*H01R 13/62* (2006.01)

(52) U.S. Cl.
USPC ..... 439/159

(58) Field of Classification Search
USPC ..... 439/157, 159–160
See application file for complete search history.

(56) References Cited

U.S. PATENT DOCUMENTS

| | | | | |
|---|---|---|---|---|
| 7,867,034 | B1 * | 1/2011 | Sato et al. | 439/630 |
| 8,033,865 | B2 * | 10/2011 | Li et al. | 439/633 |
| 8,221,143 | B2 * | 7/2012 | Yu et al. | 439/159 |
| 8,262,400 | B1 * | 9/2012 | Qu et al. | 439/188 |
| 8,308,495 | B2 * | 11/2012 | Yu et al. | 439/159 |
| 2005/0227520 | A1 * | 10/2005 | Wu | 439/159 |
| 2006/0189186 | A1 * | 8/2006 | Lin | 439/159 |

* cited by examiner

*Primary Examiner* — Jean F Duverne

(57) ABSTRACT

A card connector has a base, a card ejection mechanism and a card seat. The base has a first space for at least one set of terminals to be mounted therein, a second space with the card ejection mechanism mounted therein, and a spring leaf mounted in the second space. The card seat has a tongue. The tongue has a card-holding slot formed in a top of the tongue and mounted inside the first space of the base, and an engagement part formed on a bottom of the tongue and corresponding to the spring leaf of the base. When the card seat is inserted in the base, the engagement part of the tongue engages the spring leaf of the base for the card seat to be securely held by the base. When the card seat is removed from the base, the card ejection mechanism is pressed to squeeze the spring leaf of the base for the engagement part of the tongue to disengage from the spring leaf and the card seat can be ejected from the base.

11 Claims, 11 Drawing Sheets

CARD CONNECTOR

BACKGROUND OF THE INVENTION

1. Field of the Invention

The present invention relates to a card connector and more particularly to a card connector capable of easily and effectively reducing overall size thereof.

2. Description of the Related Art

To keep abreast with the rapid development of electronic and information technologies, consumer electronic products, such as mobile phones, MP3 players, digital cameras and so on, have their market growth in greater amount every year and apparently become indispensable products and leading trend of the new era. When operated, these electronic products need to record and store text data, static image data or dynamic audio/video data through a storage card (memory card). Hence, currently, almost every electronic product is equipped with an electronic card connector to connect with external storage cards. As to the conventional card connectors in the market, irrespective of single card connectors or combo card connectors, they are all designed to have automatic card ejection mechanism therein for users to easily remove the storage cards inside the electronic card connectors.

As disclosed by Taiwan Utility Model Patent No. M393838, an electronic card connector has an insulation body, multiple conductive terminals, a shielding case, a card ejection mechanism and a resilient element. The conductive terminals are securely mounted on the insulation body. The shielding case is mounted on the insulation body. The card ejection mechanism is mounted on the shielding case and has a slider, a resilient element and a guiding rod. The slider is slidable with respect to the insulation body. The resilient element restores the slider back to an initial state with its elastic force. A first end of the guiding rod is mounted on the insulation body and a second end of the guiding rod serves for slider to move thereon. The slider has a heart-shaped slot for the second end of the guiding rod to move inside the heart-shaped slot. Accordingly, electronic cards can be inserted in and removed from the electronic card connector.

However, due to the heart-shaped slot of the slider, the conventional card connector becomes relatively bulky. The relatively bulky slider forces the insulation body to reserve a larger space for mounting the slider so that the overall size of the electronic card connector fails to be further miniaturized. Such failure certainly run counter to the universal design requirement of electronic products, that is, being compact, thin and lightweight. Besides, to prevent a fault caused by the guiding rod jumping out of the heart-shaped slot when being moved therein, the conventional electronic card connector usually has an elastic pressing plate mounted on the shielding case. As the elastic pressing plate is formed by a stamping process, its mechanical strength tends to be relatively low and a downward stress loaded on the elastic pressing plate surely increases. As a result, when the downward stress on the elastic pressing plate is excessively high, the guiding rod can be no longer operated smoothly and the electronic card connector is unable to be normally operated.

SUMMARY OF THE INVENTION

In view of the foregoing problem, the present invention provides a card connector having a base, a card ejection mechanism and a card seat. The base has a first space for at least one set of terminals to be mounted therein, a second space with the card ejection mechanism mounted therein, and a spring leaf mounted in the second space. The card ejection mechanism can be linearly movable inside the second space, and has an ejection rod to correspond to the spring leaf of the base. The card seat has a tongue. The tongue has a card-holding slot formed in a top of the tongue and mounted inside the first space of the base for holding a storage card (memory card), and an engagement part formed on a bottom of the tongue and mounted inside the sliding zone of the second space of the base. Accordingly, when the card seat is inserted in the base and the storage card on the card seat is electrically connected with the at least one set of terminals of the base, the engagement part of the tongue engages the spring leaf of the base and the card seat is securely held by the base. When the card seat is removed from the base, the ejection rod of the card ejection mechanism is pressed to squeeze the spring leaf of the base through a linear motion so that the engagement part of the tongue disengages from the spring leaf and the card seat can be ejected from the base.

From the forgoing structure disclosed by the present invention, the size (width) reduction of the card ejection mechanism and the overall size of the card connector is attributable to a linear and reciprocating motion (movement) of the card ejection mechanism. Moreover, the ejection rod of the card ejection mechanism can be linearly moved to squeeze the spring leaf of the base for the spring leaf to disengage from the engagement part of the tongue, thereby achieving a stable card insertion and removal mechanism with the simple structural design of the card connector of the present invention.

DETAILED DESCRIPTION OF THE INVENTION

To allow the examiner to quickly and easily comprehend the characteristics and advantages of the present invention and shed the light on the achieved effect and benefit, the present invention in collaborated with the drawings depict the characteristics and advantages of the present invention in a detailed manner. Instead of narrowing and limiting the invention scope, the following embodiments are dedicated to in-depth understanding concerning the design concepts of the present invention.

Figure 1:
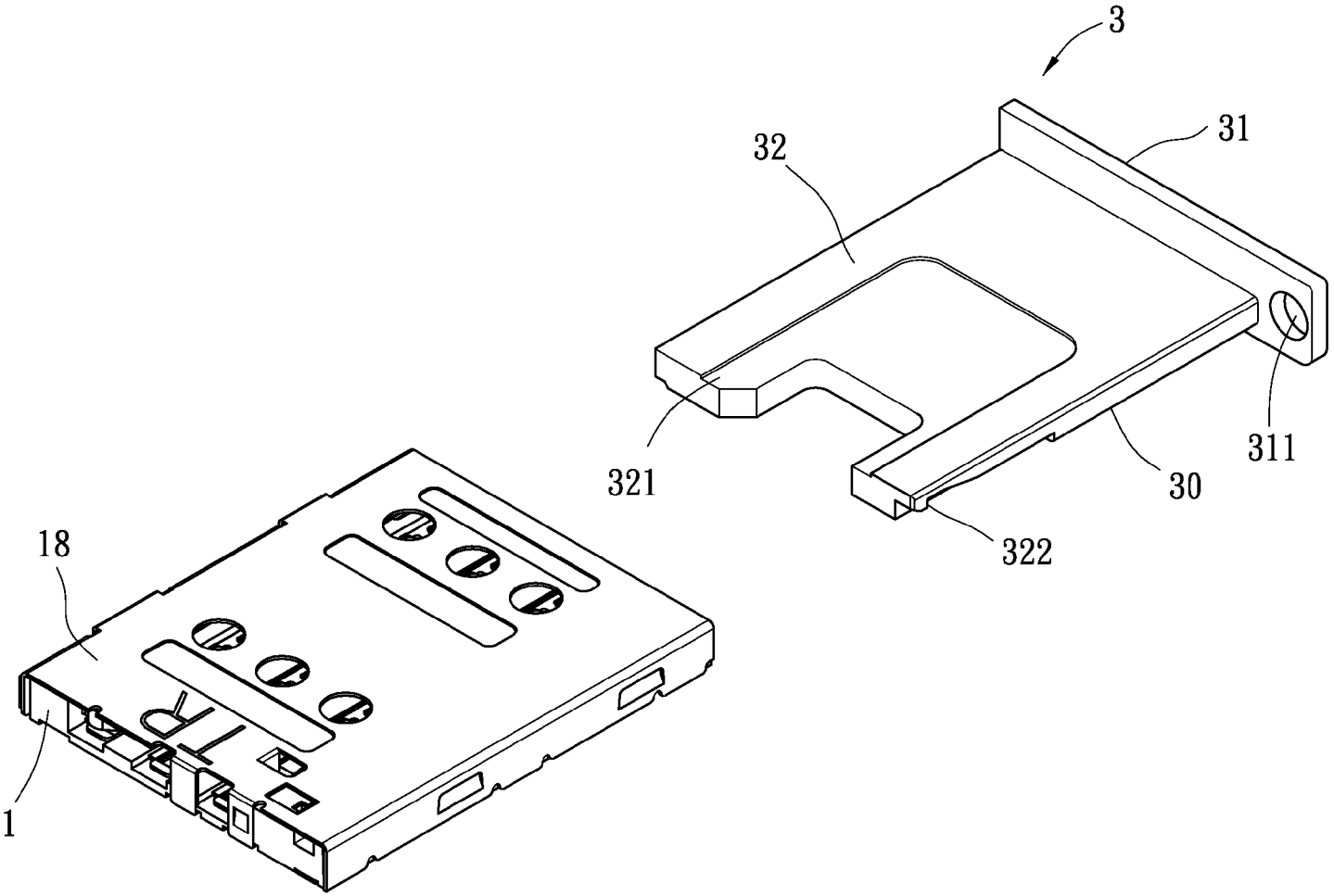
FIG. 1 is a partially exploded perspective view of a first embodiment of a card connector in accordance with the present invention.
Figure 2:
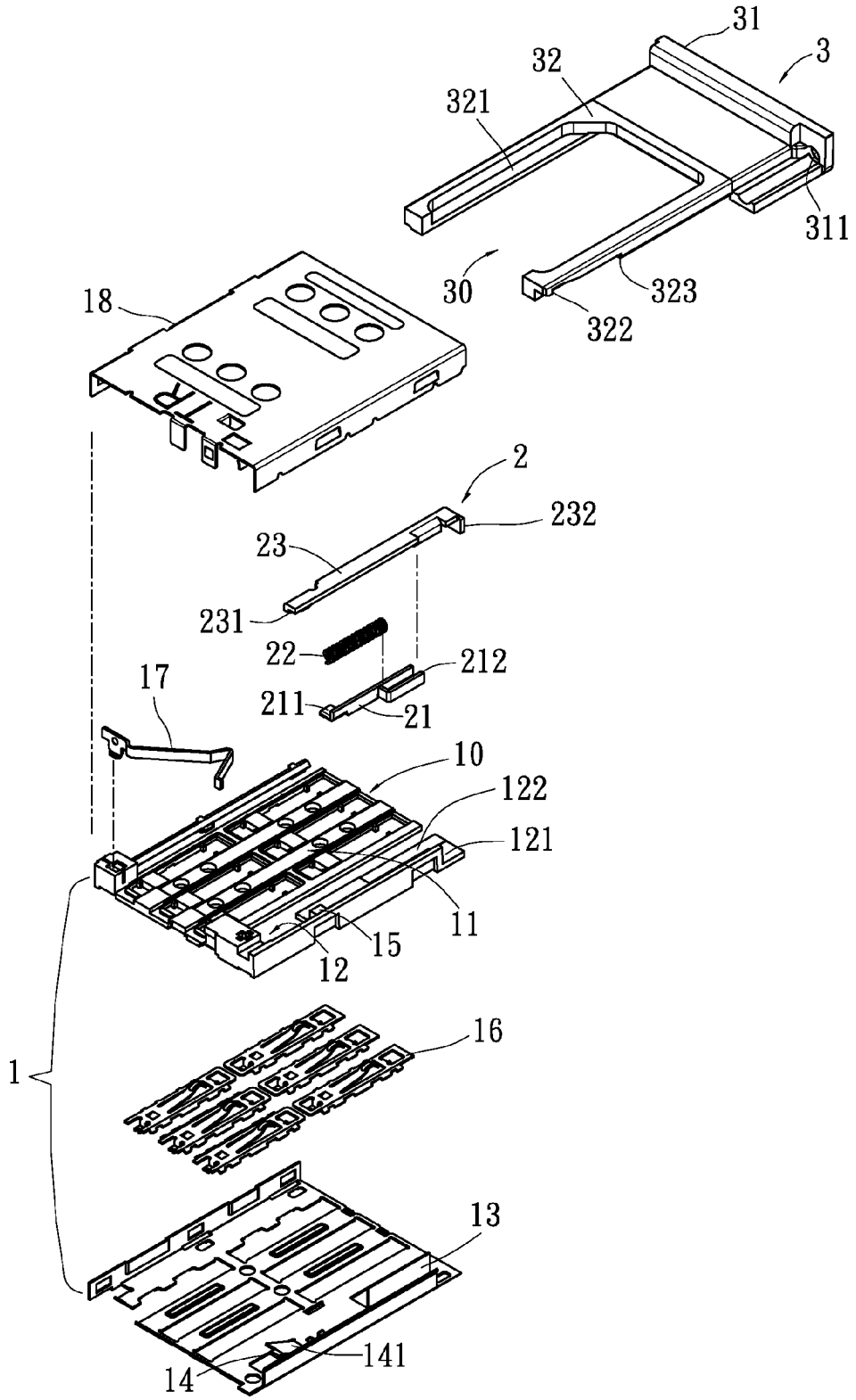
FIG. 2 is an exploded perspective view of the card connector in FIG. 1.

With reference to FIGS. 1 and 2, a first embodiment of a card connector in accordance with the present invention has a base 1, a card ejection mechanism 2 and a card seat 3.

The base 1 has an opening 10, a first space 11, a second space 12, a partition plate 13, a spring leaf 14, a protrusion 15, at least one set of terminals 16, at least one detection terminal 17 and a cover 18. The opening 10 is formed through a front of the base 1. The first space 11 and the second space 12 are defined inside the base 1, are adjacent to each other, and communicate with the first opening 10. The partition plate 13 is formed on the base 1 to divide the second space 12 into a first setting zone 121 and a sliding zone 122. The spring leaf 14 is incised from and bent upwards from the base 1, and is located on straight-line paths extending from the setting zone 121 and the sliding zone 122. The protrusion 15 is formed on and protrudes from the base 1 and is located on a straight-line path extending from the setting zone 121. The at least one set of terminals 16 is mounted inside the first space 11. The at least one detection terminal 17 is transversely mounted on the base 1, is located inside the first space 11, and is adjacent to a rear of the base 1. The cover 18 is mounted on the top of the base 1. The at least one detection terminal 17 may be <-shaped, and the cover 18 may be made of metal. In the present embodiment, the spring leaf is incised from a bottom of the base 1, and is bent upwards with a contact surface 141 facing up.

The card ejection mechanism 2 is mounted on the base 1 and is located inside the setting zone 121 of the second space 12, and has a push rod 21, a spring 22 and an ejection rod 23. The push rod 21 is mounted on the base 1, is located inside the setting zone 121 of the second space 12, is linearly and reciprocatingly movable inside the setting zone 121, and has a tab 211 and an elbow 212. The tab 211 is formed on and transversely protrudes from one side of the push rod 21 and is located in the sliding zone 122 of the second space 12. The elbow 212 is formed on an opposite side of the push rod 21 and is located in the setting zone 121 of the second space 12. The spring 22 is mounted inside the setting zone 121 of the second space 12 and is mounted between the protrusion 15 of the base 1 and the elbow 212 of the push rod 21. The ejection rod 23 is mounted inside the setting zone 121 of the second space 12, is rested on a top of the push rod 21, is linearly and reciprocatingly movable inside the setting zone 121, and has an extrusion part 231 and a pressing part 232. The extrusion part 231 is formed on one end of the ejection rod 23 and contacts the spring leaf 14 of the base 1. The extrusion part may be inclined and has an inclined surface corresponding to the contact surface 141 of the spring leaf 14. The pressing part 232 is formed on the other end of the ejection rod 23 and is adjacent to the opening 10 of the base 1.

The card seat 3 is combined with the base 1 and has a foot 31, a tongue 32 and a third space 30. The tongue 32 is formed on and protrudes from one side of the foot 31, and is mounted inside the first space 11 and the second space 12. In other words, the tongue 32 is equal to the first space 11 and a part of the second space 12 in width. The tongue 32 has a card-holding slot 321, an engagement part 322 and a rib 323. The card-holding slot 321 is formed in a top of the tongue 32 and is mounted inside the first space 11 of the base 1. The engagement part 322 and the rib 323 are formed on a bottom of the tongue 32 and are mounted inside the sliding zone 122 of the second space 12 of the base. The engagement part 322 can engage the spring leaf 14 of the base 1. The rib 323 and the tab 211 of the push rod 21 can interfere with each other. The third space 30 is recessed from one side of the tongue 32 intersecting the foot 31 to correspond to the setting zone 121 of the second space 12. The foot 31 has a through hole 311 formed therethrough to communicate with the third space 30. The card-holding slot 321 may or may not be hollowed out.

Figure 3:
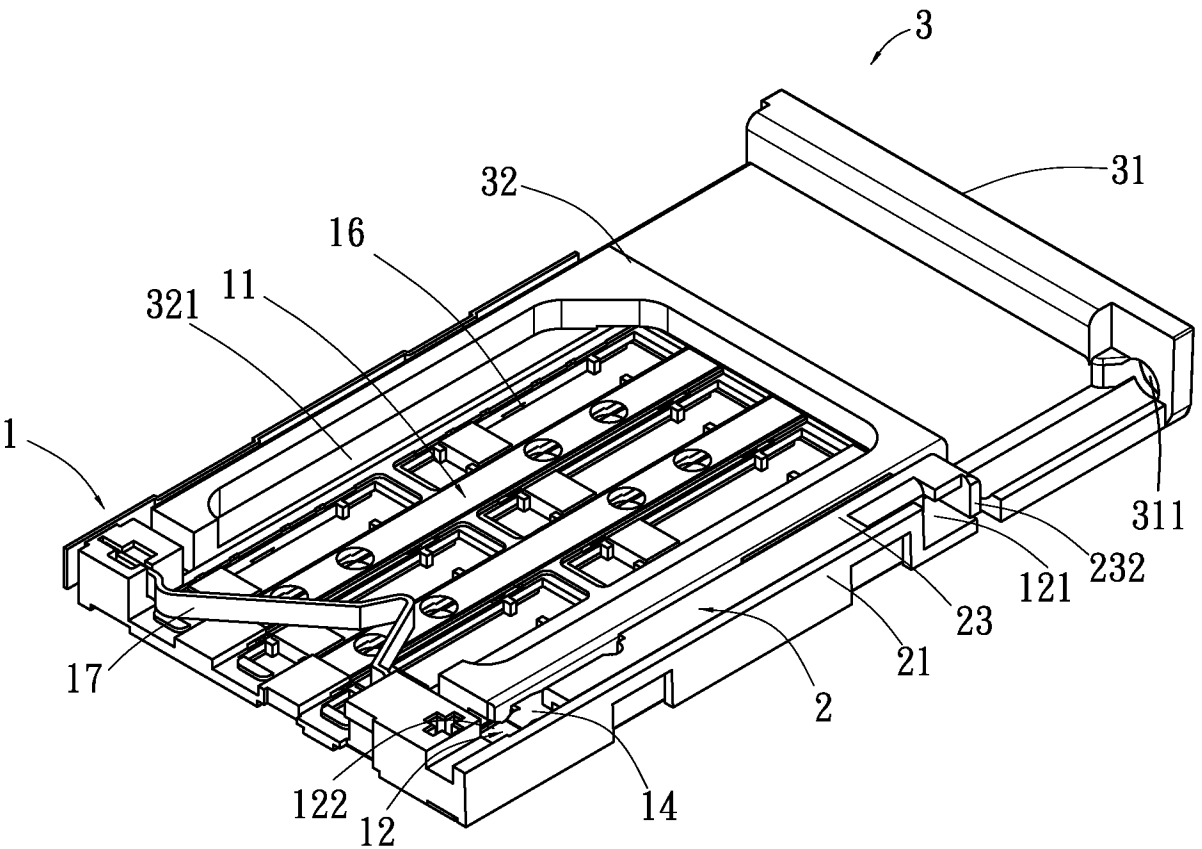
FIG. 3 is an operational perspective view of the card connector in FIG. 1 when a card seat is inserted in a base.
Figure 4:
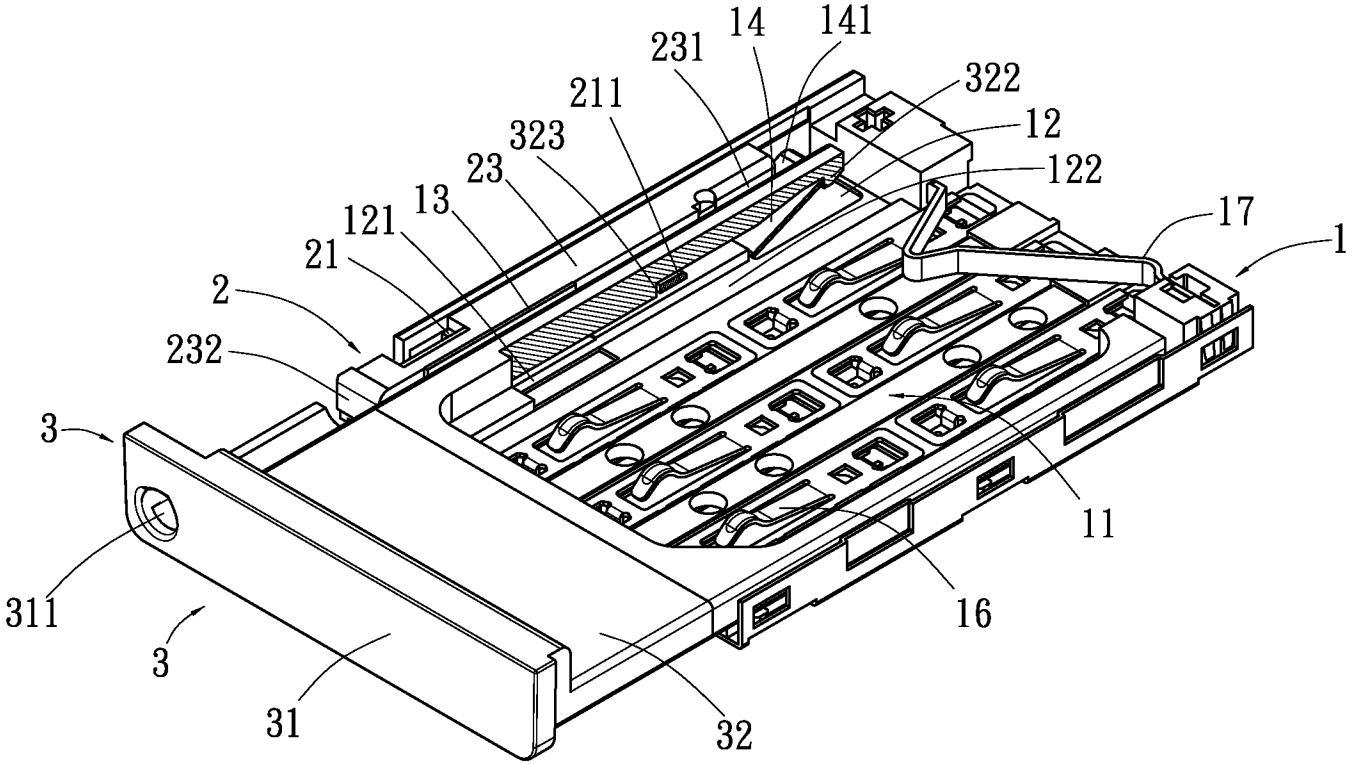
FIG. 4 is another operational perspective view of the card connector in FIG. 3.
Figure 5:
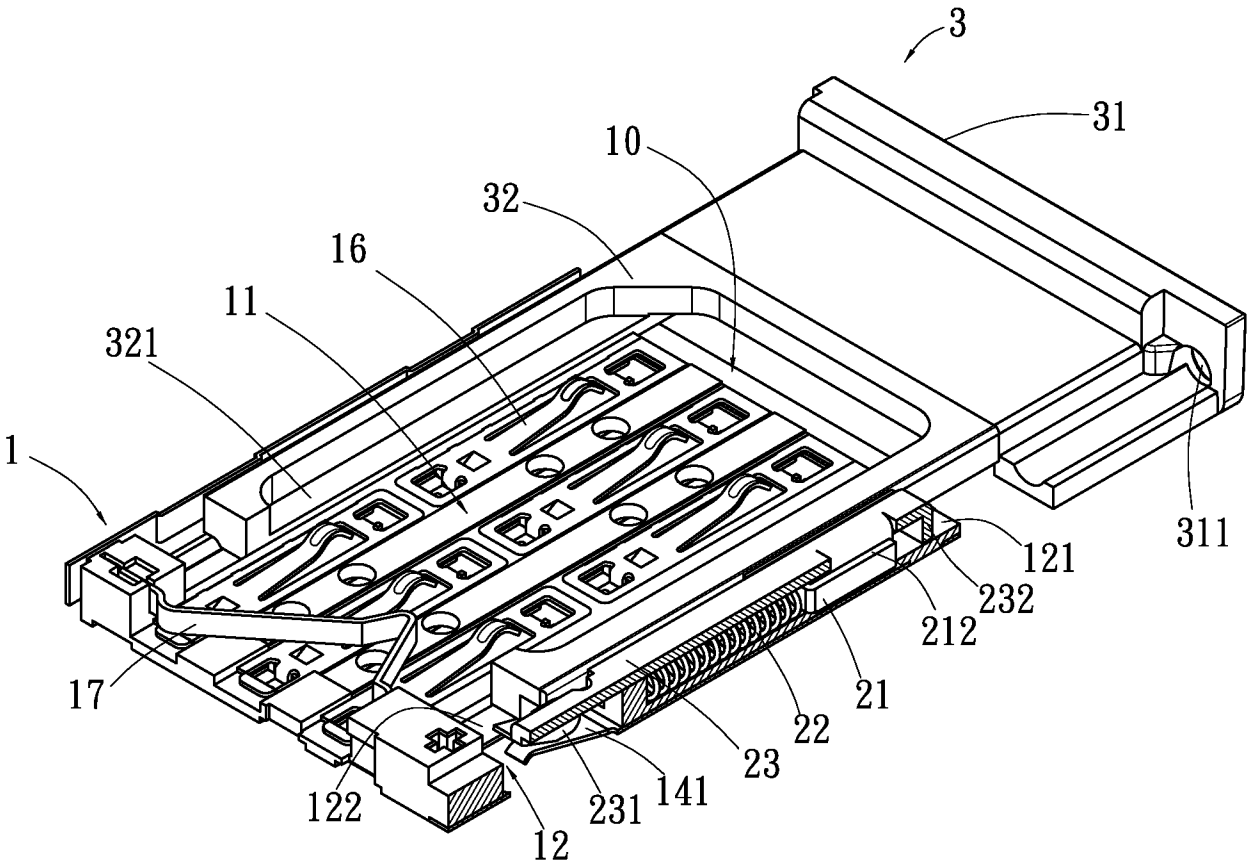
FIG. 5 is an operational perspective view of the card connector in FIG. 3 when the card seat is removed from the base.
Figure 6:
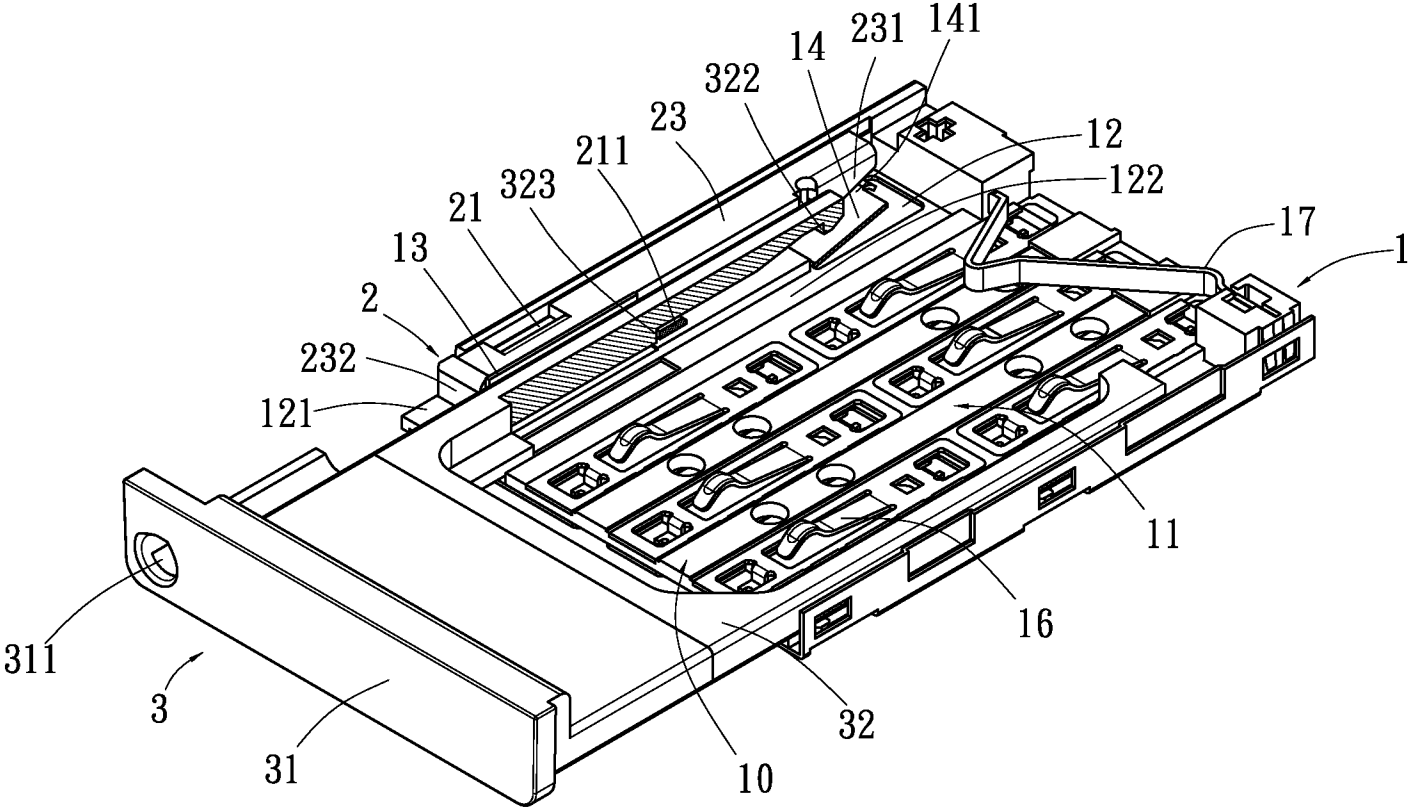
FIG. 6 is another operational perspective view of the card connector in FIG. 5.

With reference to FIGS. 3 to 6, the card-holding slot 321 is hollowed out for holding a storage card, such as a memory card, a SIM card and the like. The storage card can be held by the card-holding slot 321 with the contact terminals of the stored card uncovered. Alternatively, the card-holding slot 321 may not be hollowed out for the purpose of allowing the base 1 to be dustproof. When the card seat 3 is inserted in the base 1, the card-holding slot 321 corresponds to the first space 11 in the base 1 for the storage card in the card-holding slot 321 to be electrically connected with the at least one set of terminals 16, the engagement part 322 and the rib 323 of the card seat 3 are located inside the sliding zone 122 of the second space 12 of the base 1, and the spring leaf 14 on the base 1 is located on the straight-line paths extending from the setting zone 121 and the sliding zone 122 in the base 1. Hence, the engagement part 322 of the tongue 32 of the card seat 3 engages the spring leaf 14 of the base 1 as shown in FIGS. 3 and 4 and the card seat 3 can be securely held inside the base 1. On the other hand, when the card seat 3 is removed from the base 1, users can press the pressing part 232 of the ejection rod 23 through the through hole 311 of the card seat 3. The ejection rod 23 is then linearly movable, the extrusion part 231 of the ejection rod 23 can abut against the spring leaf 14 of the base 1, and the spring leaf 14 of the base 1 disengages from engagement part 322 of the card seat 3 as shown in FIGS. 5 and 6. Due to the restoring force of the spring 22, the spring 22 pushes the elbow 212 of the push rod 21 and the elbow 212 interferes with the rib 323 of the card seat 3 so that the push rod 21 pushes the card seat 3 to eject card seat 3 out through the opening 10 of the base 1.

Figure 7:
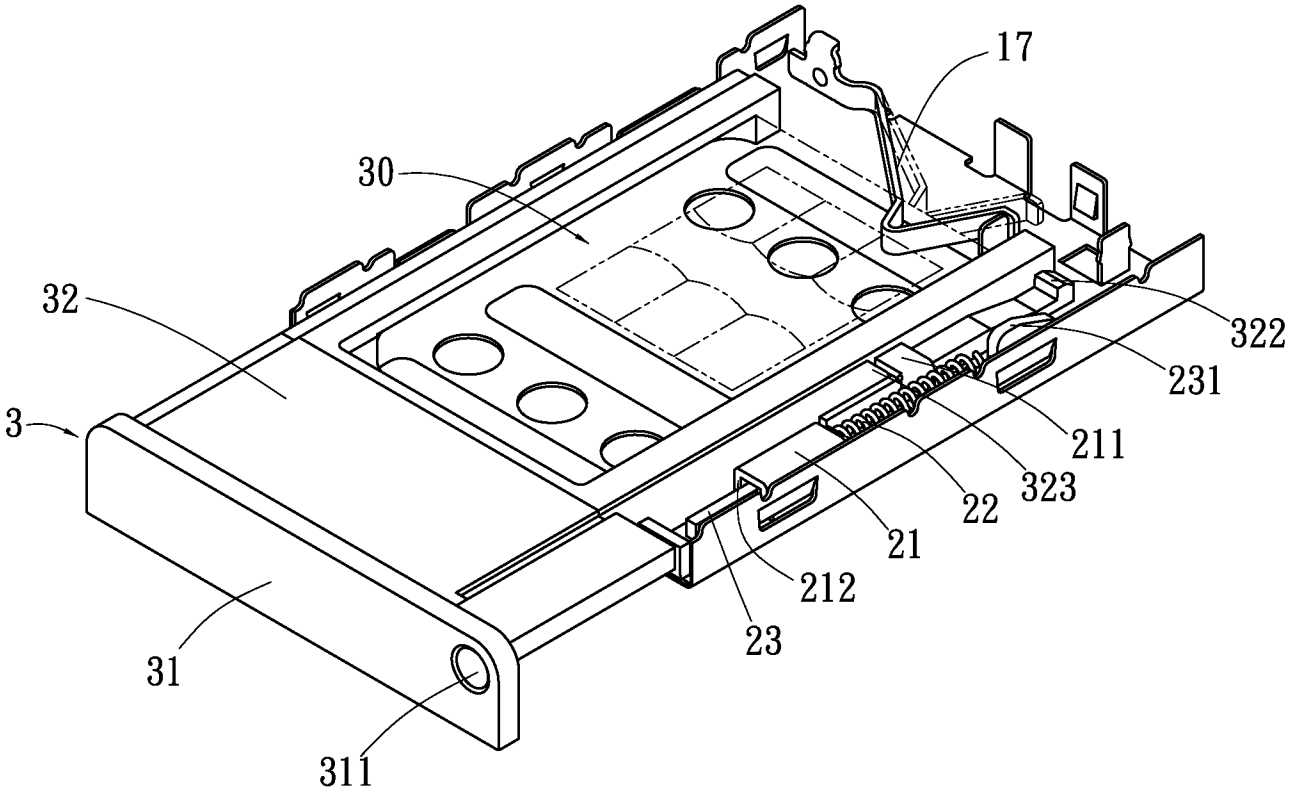
FIG. 7 is an operational perspective view of the card connector in FIG. 1 illustrating the operation of a detection terminal.

With reference to FIG. 7, when the card seat 3 is not inserted in the base 1, the detection terminal 17 contacts the cover 18 and a detection signal of detecting no inserted SIM card is in an ON state. On the contrary, when the card seat is inserted in the base 1, the storage card in the card-holding slot 321 squeezes the detection terminal 17 of the base 1, so that the detection terminal 17 is elastically deformed and is not in contact with the metal cover 18 and the detection signal is therefore in an OFF state. Hence, when the card seat 3 is inserted in the base 1, the detection terminal 17 of the base 1 is squeezed by the storage card and thus does not contact the cover 18. As a result, the detection signal is changed from an ON state to an OFF state and a preset control circuit can detect that the detection signal has been changed indicative of an inserted card inside the base 1.

Figure 8:
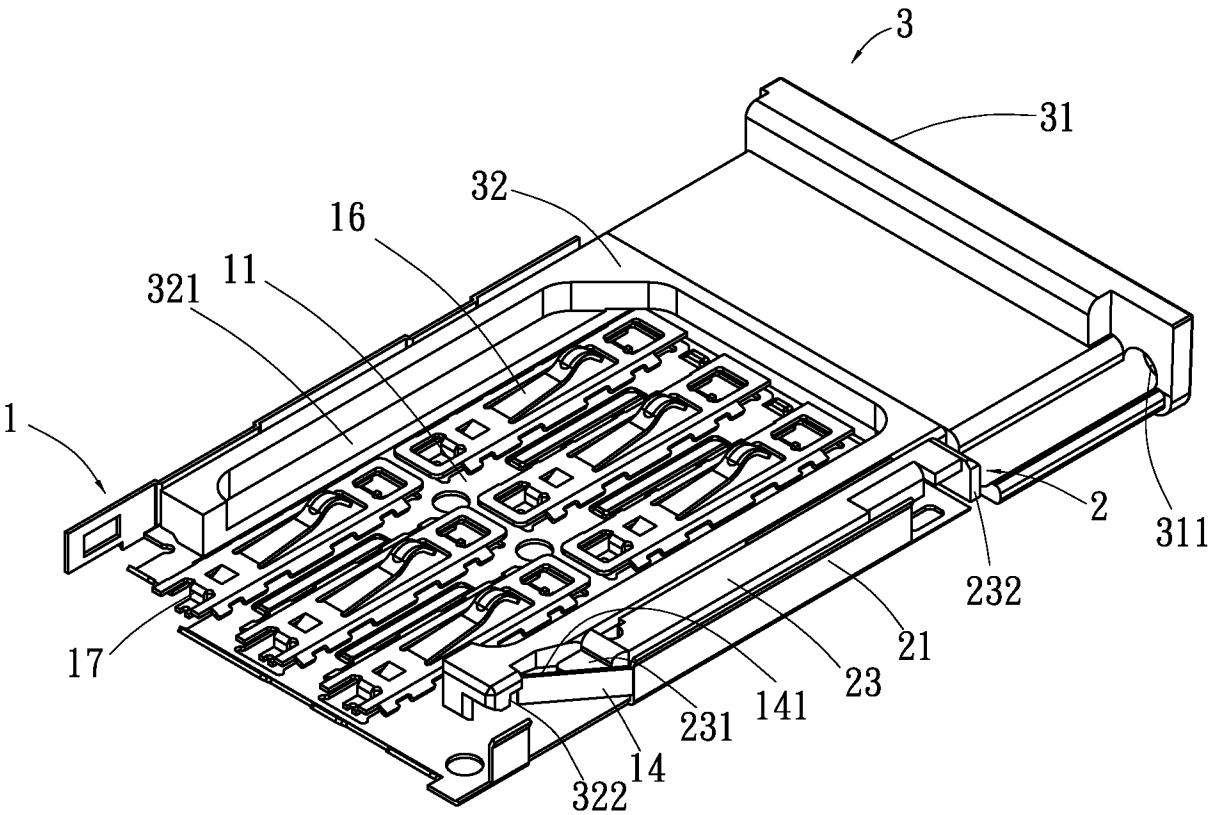
FIG. 8 is an operational perspective view of a second embodiment of a card connector in accordance with the present invention when a card seat is inserted in the base.
Figure 9:
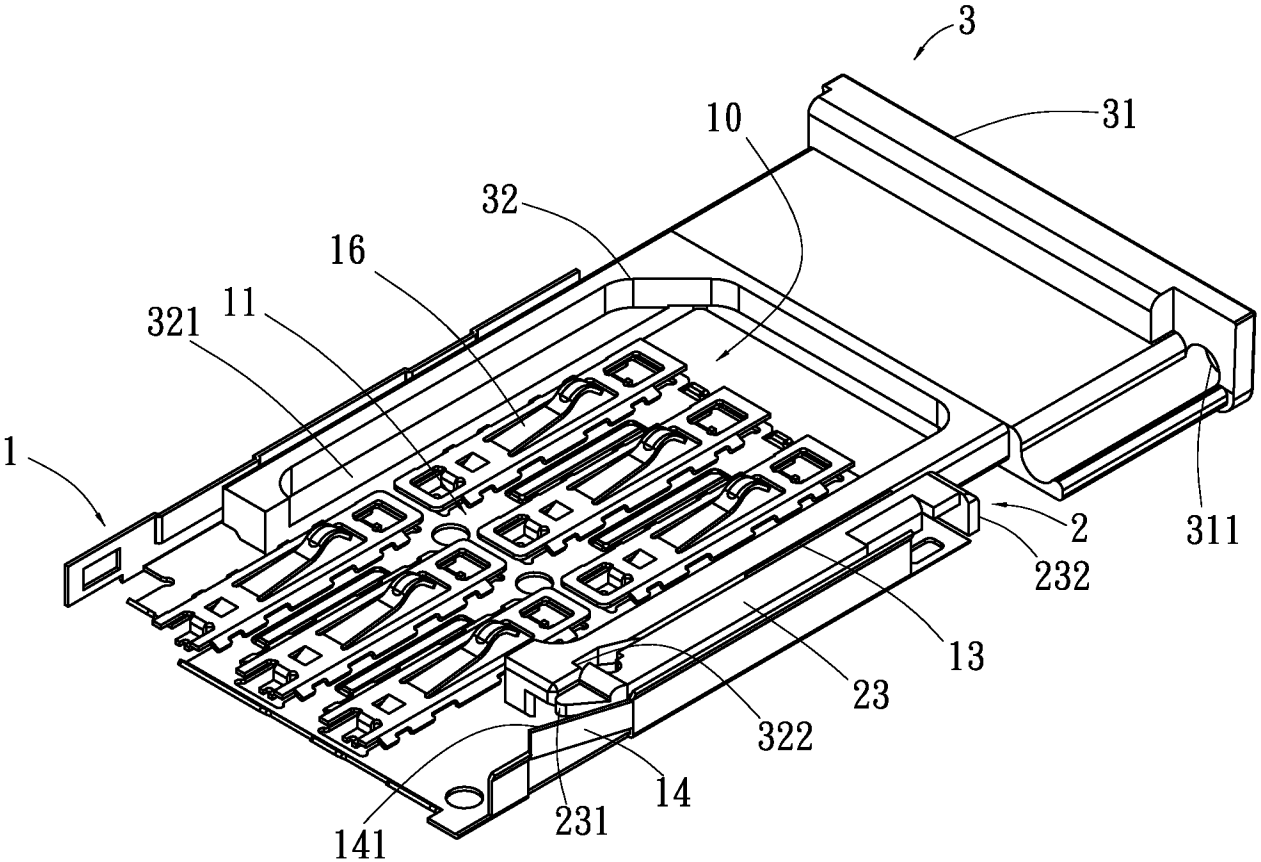
FIG. 9 is an operational perspective view of the card connector in FIG. 8 when the card seat is removed from the base.

With reference to FIGS. 8 and 9, a second embodiment of a card connector in accordance with the present invention is shown. The spring leaf 14 is incised from a side of the base 1 and is bent inwards, has a contact surface 141 facing the first space 11, and is located on straight-line paths extending from the setting zone 121 and the sliding zone 122. When the card seat 3 is inserted in the base 1, the engagement part 322 of the card seat 3 engages the spring leaf 14 of the base 1 as shown in FIG. 8, and the card seat 3 can be securely held in the base 1. When the card seat is removed from the base 1, similarly, the pressing part 232 of the ejection rod 23 is pressed, and the ejection rod 23 is then linearly movable so that the extrusion part 231 of the ejection rod 23 can abut against the spring leaf 14 of the base 1, the spring leaf 14 of the base 1 disengages from engagement part 322 of the card seat 3 as shown in FIG. 9, and the card seat can be removed from the base 1.

Figure 10:
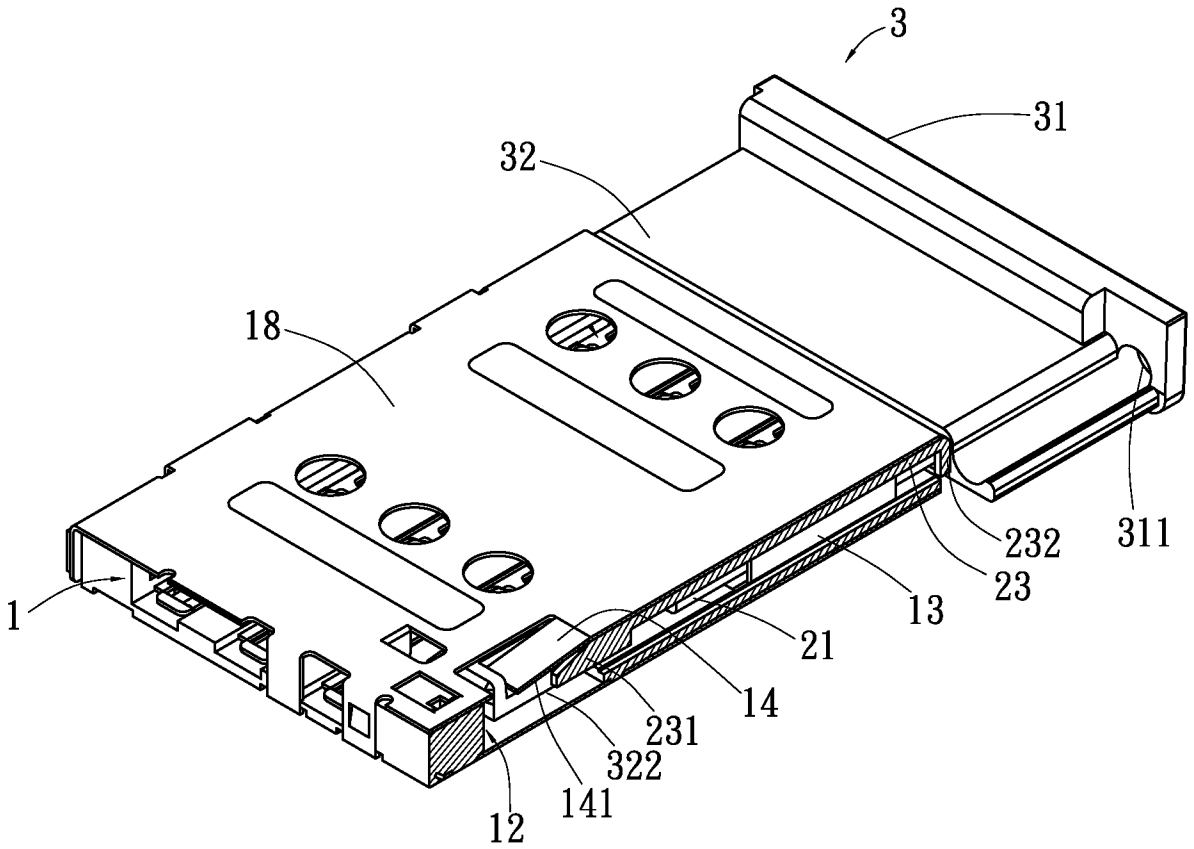
FIG. 10 is an operational perspective view of a third embodiment of a card connector in accordance with the present invention when a card seat is inserted in the base.
Figure 11:
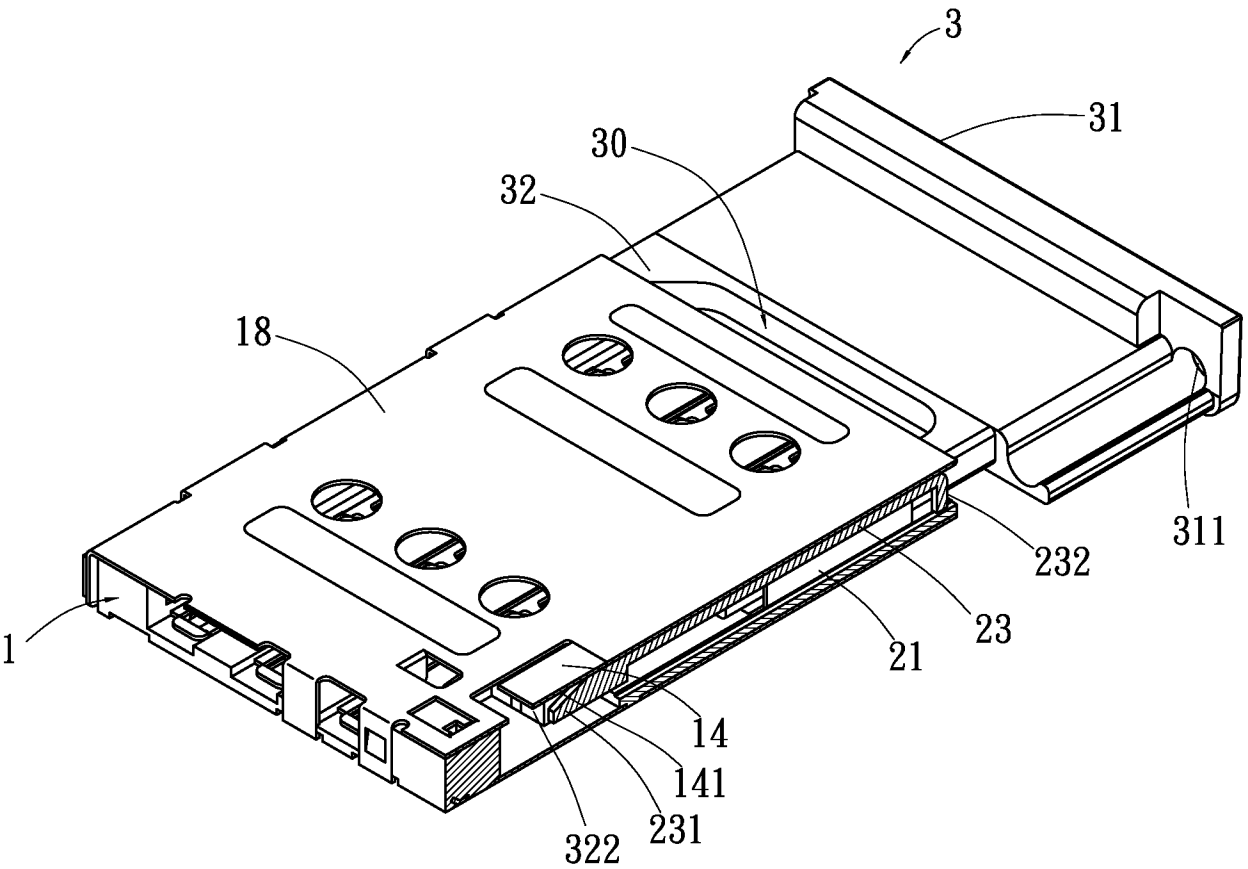
FIG. 11 is an operational perspective view of the card connector in FIG. 10 when the card seat is removed from the base.

With reference to FIGS. 10 and 11, a third embodiment of a card connector in accordance with the present invention is shown. The spring leaf 14 is incised from the cover and is bent toward an inner portion of the base 1, has a contact surface 141 facing the inner portion of the base 1, and is located on straight-line paths extending from the setting zone 121 and the sliding zone 122 of base 1. When the card seat is inserted in the base 1, the engagement part 322 of the card seat 3 engages the spring leaf 14 of the base 1 as shown in FIG. 10 and the card seat 3 can be securely held inside the base 1. When the card seat 3 is removed from the base 1, the pressing part 232 of the ejection rod 23 is pressed, and the ejection rod 23 is then linearly movable so that the extrusion part 231 of the ejection rod 23 can abut against the spring leaf 14 of the base 1, the spring leaf 14 of the base 1 disengages from engagement part 322 of the card seat 3 as shown in FIG. 11, and the card seat can be removed from the base 1.

What worth mentioning is that the base 1 has an insulating seat and a metal housing covering a bottom of the insulating seat. The partition plate is produced by stamp-forming the metal housing. If the spring leaf 14 is formed on the bottom or the lateral side of the base 1, the spring leaf 14 can be produced by stamp-forming the metal housing. If the spring leaf 14 is formed on the cover 18, the spring leaf 14 can be produced by stamp-forming the cover 18.

In sum, the present invention is characterized by the card ejection mechanism with a linear and reciprocating motion effectively solving the bulky size issue of the conventional card connectors arising from a slider with a heart-shaped slot. The push rod 21, the spring 22 and the ejection rod 23 of the card ejection mechanism 2 can be combined with one another, thereby further effectively reducing the size (the width in particular) of the card ejection mechanism 2 and the overall size of the card connector. Additionally, the card ejection mechanism 2 is driven to squeeze the spring leaf 14 of the base 1 by means of the linear motion of the ejection rod 23 for the spring leaf 14 to disengage from the engagement part 322 of the card seat 3. Accordingly, based on the foregoing simple structural design, the card connector of the present invention can have a stable card insertion and removal mechanism.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A card connector comprising:

a base having:

an opening formed through a front of the base;

a first space and a second space defined inside the base, being adjacent to each other, and communicating with the first opening;

a partition plate formed on the base to divide the second space into a first setting zone and a sliding zone;

a spring leaf incised from and bent upwards from the base and located on straight-line paths extending from the setting zone and the sliding zone;

a protrusion formed on and protruding from the base and located on a straight-line path extending from the setting zone; and at least one set of terminals mounted inside the first space;

a card ejection mechanism mounted on the base and located inside the setting zone of the second space, and having:

a push rod mounted on the base and located inside the setting zone of the second space, and having:

a tab formed on and transversely protruding from one side of the push rod and located in the sliding zone of the second space; and an elbow formed on an opposite side of the push rod and located in the setting zone of the second space;

a spring mounted inside the setting zone of the second space and mounted between the protrusion of the base and the elbow of the push rod; and an ejection rod mounted inside the setting zone of the second space, and having:

an extrusion part formed on one end of the ejection rod and contacting the spring leaf of the base; and a pressing part formed on the other end of the ejection rod and being adjacent to the opening of the base; and a card seat combined with the base and having:

a foot;

a tongue formed on and protruding from one side of the foot, mounted in the first space and the second space, and having:

a card-holding slot formed in a top of the tongue and mounted inside the first space of the base;

an engagement part formed on a bottom of the tongue and mounted inside the sliding zone of the second space of the base, and engaging the spring leaf of the base; and a rib formed on a bottom of the tongue and mounted inside the sliding zone of the second space of the base, and interfering with the tab of the push rod; and a third space recessed from one side of the tongue intersecting the foot to correspond to the setting zone of the second space, wherein the foot has a through hole formed therethrough to communicate with the third space.

2. The card connector as claimed in claim 1, wherein the base further has:

at least one detection terminal transversely mounted on the base, located inside the first space, and being adjacent to a rear of the base; and a cover made of metal and mounted on the top of the base, wherein the at least one detection terminal is elastically deformable to be in contact with the cover.

3. The card connector as claimed in claim 1, wherein the spring leaf is incised from and bent upwards from a bottom of the base.

4. The card connector as claimed in claim 1, wherein the spring leaf is incised from and bent inwards from a side of the base.

5. A card connector comprising:

a base having:

an opening formed through a front of the base;

a first space and a second space defined inside the base, being adjacent to each other, and communicating with the first opening;

a partition plate formed on the base to divide the second space into a first setting zone and a sliding zone;

a spring leaf incised from and bent upwards from the base and located on straight-line paths extending from the setting zone and the sliding zone;

a protrusion formed on and protruding from the base and located on a straight-line path extending from the setting zone; and at least one set of terminals mounted inside the first space; and a card ejection mechanism mounted on the base and located inside the setting zone of the second space, and having:

a push rod mounted on the base and located inside the setting zone of the second space, and having:

a tab formed on and transversely protruding from one side of the push rod and located in the sliding zone of the second space; and an elbow formed on an opposite side of the push rod and located in the setting zone of the second space;

a spring mounted inside the setting zone of the second space and mounted between the protrusion of the base and the elbow of the push rod; and an ejection rod mounted inside the setting zone of the second space, and having:

an extrusion part formed on one end of the ejection rod and contacting the spring leaf of the base; and a pressing part formed on the other end of the ejection rod and being adjacent to the opening of the base.

6. The card connector as claimed in claim 5, further comprising a card seat combined with the base and having:

a foot;

a tongue formed on and protruding from one side of the foot, mounted in the first space and the second space, and having:

a card-holding slot formed in a top of the tongue and is mounted inside the first space of the base;

an engagement part formed on a bottom of the tongue and mounted inside the sliding zone of the second space of the base, and engaging the spring leaf of the base; and a rib formed on a bottom of the tongue and mounted inside the sliding zone of the second space of the base, and interfering with the tab of the push rod; and a third space recessed from one side of the tongue intersecting the foot to correspond to the setting zone of the second space, wherein the foot has a through hole formed therethrough to communicate with the third space.

7. The card connector as claimed in claim 5, wherein the base further has:

at least one detection terminal transversely mounted on the base, located inside the first space, and being adjacent to a rear of the base; and a cover is made of metal and is mounted on the top of the base, wherein the at least one detection terminal is elastically deformable to be in contact with the cover.

8. The card connector as claimed in claim 5, wherein the spring leaf is incised from and bent upwards from a bottom of the base.

9. The card connector as claimed in claim 5, wherein the spring leaf is incised from and bent inwards from a side of the base.

10. A card connector comprising:

a base having:

an opening formed through a front of the base;

a first space and a second space defined inside the base, being adjacent to each other, and communicating with the first opening;

a partition plate formed on the base to divide the second space into a first setting zone and a sliding zone;

a protrusion formed on and protruding from the base and located on a straight-line path extending from the setting zone;

at least one set of terminals mounted inside the first space; and a cover made of metal, mounted on the top of the base, and having a spring leaf incised from the cover and bent toward an inner portion of the base and located on straight-line paths extending from the setting zone and the sliding zone;

a card ejection mechanism mounted on the base and located inside the setting zone of the second space, and having:

a push rod mounted on the base and located inside the setting zone of the second space, and having:

a tab formed on and transversely protruding from one side of the push rod and located in the sliding zone of the second space; and an elbow formed on an opposite side of the push rod and located in the setting zone of the second space;

a spring mounted inside the setting zone of the second space and mounted between the protrusion of the base and the elbow of the push rod; and an ejection rod mounted inside the setting zone of the second space, and having:

an extrusion part formed on one end of the ejection rod and contacting the spring leaf of the base; and a pressing part formed on the other end of the ejection rod and being adjacent to the opening of the base; and a card seat combined with the base and having:

a foot;

a tongue formed on and protruding from one side of the foot, mounted in the first space and the second space, and having:

a card-holding slot formed in a top of the tongue and mounted inside the first space of the base;

an engagement part formed on a bottom of the tongue and mounted inside the sliding zone of the second space of the base, and engaging the spring leaf of the base; and a rib formed on a bottom of the tongue and mounted inside the sliding zone of the second space of the base, and interfering with the tab of the push rod; and a third space recessed from one side of the tongue intersecting the foot to correspond to the setting zone of the second space, wherein the foot has a through hole formed therethrough to communicate with the third space.

11. The card connector as claimed in claim 10, wherein the base further has at least one detection terminal transversely mounted on the base, located inside the first space, being adjacent to a rear of the base, and being elastically deformable to be in contact with the cover.

* * * * *